United States Patent [19]

Mueller

[11] Patent Number: 4,855,567

[45] Date of Patent: Aug. 8, 1989

[54] FROST CONTROL SYSTEM FOR HIGH-SPEED HORIZONTAL FOLDING DOORS

[75] Inventor: Louis Mueller, Richfield, Wis.

[73] Assignee: Rytec Corporation, Jackson, Wis.

[21] Appl. No.: 144,572

[22] Filed: Jan. 15, 1988

[51] Int. Cl.[4] ..... H05B 3/20

[52] U.S. Cl. ..... 219/218; 62/275; 62/256; 219/213

[58] Field of Search ..... 219/218, 213, 522, 219, 219/543; 62/275, 255, 256, 248

[56] References Cited

U.S. PATENT DOCUMENTS

| | | | |
|---|---|---|---|
| 1,992,011 | 2/1935 | Knight | 62/89 |
| 2,238,511 | 4/1941 | Thaxter | 62/89 |
| 2,420,240 | 5/1947 | Haggerty | 62/89 |
| 2,460,469 | 2/1949 | Rifkin | 62/89 |
| 2,493,125 | 1/1950 | Foster | 219/213 |
| 2,731,804 | 1/1956 | Grubbs | 219/218 |
| 2,809,402 | 10/1957 | Southworth | 219/218 |
| 2,858,408 | 10/1958 | Barroero | 219/218 |
| 2,984,085 | 5/1961 | Rainwater | 62/256 |
| 3,064,110 | 11/1962 | Vogler | 219/522 |
| 3,135,100 | 6/1964 | Taylor | 652/275 |
| 3,186,185 | 6/1965 | Bently | 62/255 |
| 3,254,503 | 6/1966 | Rundell | 62/275 |
| 3,449,925 | 6/1969 | Barroero | 62/275 |
| 3,462,885 | 10/1967 | Miller | 219/218 |
| 3,612,821 | 10/1971 | Stromquist | 62/248 |
| 3,697,723 | 10/1972 | Winsler | 62/248 |
| 3,869,873 | 3/1975 | Thomas | 62/275 |
| 4,080,764 | 3/1978 | Stowik | 52/173 R |
| 4,083,395 | 4/1978 | Romano | 160/84 R |
| 4,109,484 | 8/1978 | Cunningham | 62/256 |
| 4,274,467 | 6/1981 | Comeau | 160/84 R |
| 4,289,190 | 9/1981 | Catan | 160/322 |
| 4,313,485 | 2/1982 | Gidge | 160/328 |
| 4,335,777 | 6/1982 | Simon | 160/332 |
| 4,355,678 | 10/1982 | Romano | 160/332 |
| 4,388,961 | 6/1983 | Schaefer | 160/332 |
| 4,420,027 | 12/1983 | Gidge | 160/328 |
| 4,448,232 | 5/1984 | McQueen | 160/207 |
| 4,449,270 | 5/1984 | Brabant | 16/87.4 R |

FOREIGN PATENT DOCUMENTS

| | | |
|---|---|---|
| 3048763 | 9/1983 | Fed. Rep. of Germany . |
| 1554159 | 10/1979 | United Kingdom . |
| 2080379 | 2/1982 | United Kingdom . |

OTHER PUBLICATIONS

Electrical Construction and Maintenance, "Infrared Quartz Lamps", vol. 67, No. 7, Jul. 1968.

*Primary Examiner*—Teresa J. Walberg
*Attorney, Agent, or Firm*—Foley & Lardner

[57] ABSTRACT

A frost resistant, horizontal folding door for a freezer room has heater assemblies in the header, jambs and for simultaneously heating the door curtain and the floor of the doorway. The heater assembly in the header can be a mat of open mesh fiber glass having a serpentine array of an electric resistance heating wire bonded to it. The heater assembly in the jamb can be a formable electrical resistance heater within the structure of the jamb. The heater assembly, for the door curtain and the floor of the doorway can be an electrical radiant heater disposed on the header and directed at the curtain and the floor.

18 Claims, 4 Drawing Sheets

FROST CONTROL SYSTEM FOR HIGH-SPEED HORIZONTAL FOLDING DOORS

TECHNICAL FIELD

This invention relates to a system for controlling the buildup of frost or ice on the operating mechanism or on the curtain material or in the door opening of a high-speed, horizontal folding door used in a low temperature environment such as a freezer case in a cold storage warehouse, meat packing facility, frozen food plant or the like.

BACKGROUND OF THE INVENTION

In the early 1980's high-speed horizontal folding doors were introduced successfully into industrial and commercial use in Europe. The first such doors were installed in the United States in about 1985. These doors are typified by a horizontally folding door curtain, a header at the top of the door which supports the door suspension and contains an electrical, pneumatic or hydraulic actuating mechanism which causes the door curtain to rapidly fold to one or both of the outer edges or jambs of the door frame into a fan-fold position. The door curtain is attached to folding arms at the top of the door opening which are in turn suspended from a guide track attached to the header and connected to the actuating mechanism within the header. The door curtain itself may be in the form of panels of fabric or other sturdy, flexible material descending from the folding arms. Optimally, this descending curtain is made of a strong, clear, flexible plastic material which permits it to serve its function as a closure for the door opening while permitting the operators of vehicles and the like to see through the door for safety and traffic control purposes. Vertical hinge means at one or both sides or jambs of the door opening cooperate with the folding mechanism within the header of the door and retain the outermost edge of the door curtain within close proximity to the door jamb.

A pioneering example of such a door is found in German Pat. No. 3,048,763 to Klein.

These high-speed see-through doors have revolutionized the industrial door business. Because the doors are transparent, operators can see through them readily, insuring that safety is maintained. Such doors can be fast operating—a typical 35' door cycling opened and closed in 5 seconds or less. A typical 10' door of this type can cycle in 3 seconds or less.

Because the doors are able to operate so rapidly, as compared to previously available industrial sliding, rollup or swinging doors, they are particularly useful in situations where there is a sizable difference between the temperatures on either side of the door. A typical example would be a warehouse where such a high-speed, horizontal folding door may be utilized between an air-conditioned working structure and an outside loading dock. The door, in such a case, would be fitted with an automatic control in the form of an electric eye beam, pressure tredle or the like which would actuate the door when triggered by a forklift or other vehicle. The door would open rapidly, the forklift would go through actuating a closing control circuit, and the door would swiftly close behind, thereby minimizing the amount of time the door was open and helping to preserve the air-conditioned environment on the inside of the building. No other type of previously known industrial or commercial door is as effective as the high speed, horizontal folding door for such installations.

Another advantage of high-speed, horizontal folding doors is that they may be manufactured easily in a variety of large sizes up to about 50' wide and 28' high and are thus suitable for a wide variety of industrial and commercial applications.

Industrial doors comprising a series of adjacent flexible plastic strips suspended from a doorway are generally known in the prior art. See, for example, Catan U.S. Pat. No. 4,289,190 issued Sept. 15, 1981, Barbant U.S. Pat. No. 4,449,270 issued May 22, 1984, Schaefer U.S. Pat. No. 4,388,961 issued June 21, 1983, Romano U.S. Pat. No. 4,355,678 issued Oct. 26, 1982, Simon U.S. Pat. No. 4,335,777 issued June 22, 1982, and Sills U.K. Patent Application No. 2,080,379 published Feb. 3, 1982.

High-speed industrial folding doors of the type previously discussed include a door curtain in the form of a series of overlapping panels, strips or hinged sections which draw to one side in a fan-folded position. Typical suspension systems for such folding door curtains include a series of rack sections connected to each corresponding section of the curtain secured to suitable means for effecting a fan-fold opening and closing movement. Each rack section typically can be connected to an overhead guide track by a series of pins pivotally connected to rollers, as illustrated by Romano U.S. Pat. No. 4,083,395 issued Apr. 11, 1978. In lieu of rollers, simple sliding support devices can be employed, such as described in Sandall U.K. Patent Specification No. 1,554,159 published Oct. 17, 1979. The wheels or support devices are typically interlocked with the guide track. Comeau U.S. Pat. No. 4,274,467 issued June 23, 1981, illustrates such a fan-fold type drapery suspension system.

As described previously, high-speed, horizontal folding doors have proved highly useful, particularly in industrial situations where the environment on one side of the door is markedly different from the environment on the other side of the door. A further example of a situation of this sort which can provide very difficult operating conditions for such a door is a meat packing plant in which the plant building contains a freezer room in which meat is kept in a frozen condition. In such a situation the main part of the building might be at normal room temperature, say 60° to 70° F., while the freezer compartment would be at 30° F. or less. Because of the large amount of money invested in energy for keeping such freezer rooms cold, in the past such rooms have been typically fitted with doors of one kind or another. The high-speed, horizontal folding door of the sort previously described is particularly suited to such an application and enables vehicles and workmen to pass in and out of the freezer compartment with a minimum door opening time and with good visibility.

In practice, in such an environment, a number of problems arise. For example, contact of warm, moisture laden air from the warm side of the door opening with the chilled components of the door causes frost and ice to form on the door components and the floor of the door opening.

In particular, frost or ice formation at four separate locations in horizontal folding door installations causes interference with the proper function of the door. These are:

(1) at the header and guide track where the door-actuating mechanism is located. If frost or ice forms sufficiently thickly on the header or guide track, it interferes with the movement of the folding arms, the seal members or the carriage of the door, thereby negatively affecting the operation of the door;

(2) at the side hinge pipe or pipes of the door where ice formation on the side jambs of the door causes interference with the hinge pipe on which the outermost panel of the door pivots, thereby affecting the overall operation of the door;

(3) on the material of the door itself. Since these doors are particularly effective when made out of a transparent material so that vehicle operators and others may see through door in advance of door opening, any formation of frost or ice obscuring vision through the door would defeat one of the principle purposes of such a door; and (4) on the floor of the door opening. Frost and ice accumulation at this point is plainly a safety risk and must be controlled. Frost and ice accumulation on the floor of the door opening can also present operational difficulties. If frost and ice build up sufficiently, it can reach the lower edges of the transparent, flexible strips of the door curtain, abrading and damaging the edges. In some cases, frost on the floor is brushed toward the jambs of the door by the movement of the door curtain and eventually accumulates in the area of the jambs. Such accumulation interferes with the proper folding of the individual panels of the door curtain.

In the past, the art has made numerous attempts to deal with frost and ice formation in doors for various refrigerated structures. Numerous workers in the prior art have endeavored to use various heating devices to prevent frost formation around the sealing edges of conventional swinging doors as found on household refrigerators and freezers. See, for example, Knight U.S. Pat. No. 1,992,011 issued Feb. 19, 1935; Haggerty U.S. Pat. No. 2,420,240 issued May 6, 1947; Foster U.S. Pat. No. 2,493,125 issued Jan. 3, 1950; Southworth U.S. Pat. No. 2,809,402 issued Oct. 15, 1957; Taylor U.S. Pat. No. 3,135,100 issued June 2, 1964; Grubbs U.S. Pat. No. 2,731,804 issued Jan. 24, 1956; Rundell U.S. Pat. No. 3,254,503 issued June 7, 1966; Thomas U.S. Pat. No. 3,869,873 issued Mar. 11, 1975; Stowik U.S. Pat. No. 4,080,764 issued Mar. 28, 1978; Thaxter U.S. Pat. No. 2,238,511 issued Apr. 15, 1941; Barroero U.S. Pat. No. 2,858,408 issued Oct. 28, 1958; Barroero U.S. Pat. No. 3,449,925 issued June 17, 1969; Rifkin U.S. Pat. No. 2,460,469 issued Feb. 1, 1949; Miller U.S. Pat. No. 3,462,885 issued Aug. 26, 1969; McQueen U.S. Pat. No. 4,448,232 issued May 15, 1984; Gidge U.S. Pat. No. 4,313,485 issued Feb. 2, 1982 and Gidge U.S. Pat. No. 4,420,027 issued Dec. 13, 1983.

Workers in the prior art have also endeavored to devise various systems to prevent frost and ice interference with horizontal and vertical sliding doors, for example, in Thaxter U.S. Pat. No. 2,238,511 issued Apr. 15, 1941; Barroero U.S. Pat. No. 2,858,408 issued Oct. 28, 1958; Barroero U.S. Pat. No. 3,449,925 issued June 17, 1969.

The prior art has also endeavored to prevent frost formation at the sealing joints of refrigerated cases utilizing pull-out drawers, e.g., Rifkin U.S. Pat. No. 2,460,469 issued Feb. 1, 1949.

Rytec Corporation of Jackson, Wisconsin has marketed high-speed folding doors including flaccid heat wires in the header and jambs of the door for frost prevention. In these prior art doors the flaccid heat wires were retained in place by heat resistant tape. In practice it was found that such a structure was slow and expensive to manufacture and that the taped-in-place heat wires did not always stay in place in service resulting in non-uniform heating of the header or jamb and attendant service problems.

As is evident, the art has not successfully directed itself to the prevention of frost and ice formation in high-speed, horizontal folding doors or in the prevention of frost and ice formation which interferes with the actuating mechanism of a power operated door at low manufacturing cost and good in-service reliability.

Nor has the prior art directed its attention to the prevention of frost and ice formation on the clear curtain panels of a high-speed folding door, although transparent curtain doors have been used in environments where frost formation is likely to be a problem; e.g. Gidge U.S. Pat. No. 4,313,485 issued Feb. 2, 1982 and Gidge U.S. Pat. No. 4,420,027 issued Dec. 13, 1983.

The present invention substantially prevents frost and ice formation interfering with the action of a high-speed, power operated horizontal folding door and substantially prevents ice and frost formation on the transparent descending curtain of a folding door and on the floor of the door opening. The present invention does so with low utilization of energy; at relatively low manufacturing cost; with manufacturing ease and with in-service reliability.

SUMMARY OF THE INVENTION

A high-speed, horizontal folding door for use in refrigerated cases according to the present invention includes an elongated guide track and actuating mechanism in association with a header including a suitable door actuating mechanism. In close proximity with the header is a folding arm mechanism which permits the door to fold while opening and closing and provides the means whereby the curtain of the door is suspended. At one or both of the opposing jambs of the door vertical hinge pipes are provided on which the outermost panel and suspending arms of the door pivots during the operation of the door.

The frost control system for such a door in accordance with the present invention includes heating elements at the header and jambs of the door at those locations where frost or ice formation interfere with the operation of the door, obscure vision through a transparent door curtain or create a safety hazard. In practice, four such locations are the exterior of the header of the door in close proximity to the guide track, moving arms and seal members of the door, the door jamb or jambs, the door curtain and the floor of the door opening.

DESCRIPTION OF THE DRAWINGS

The invention will be further described with reference to the appended drawings wherein like numerals denote like elements, and.

DETAILED DESCRIPTION OF THE PREFERRED EXEMPLARY EMBODIMENTS

Figure 2:
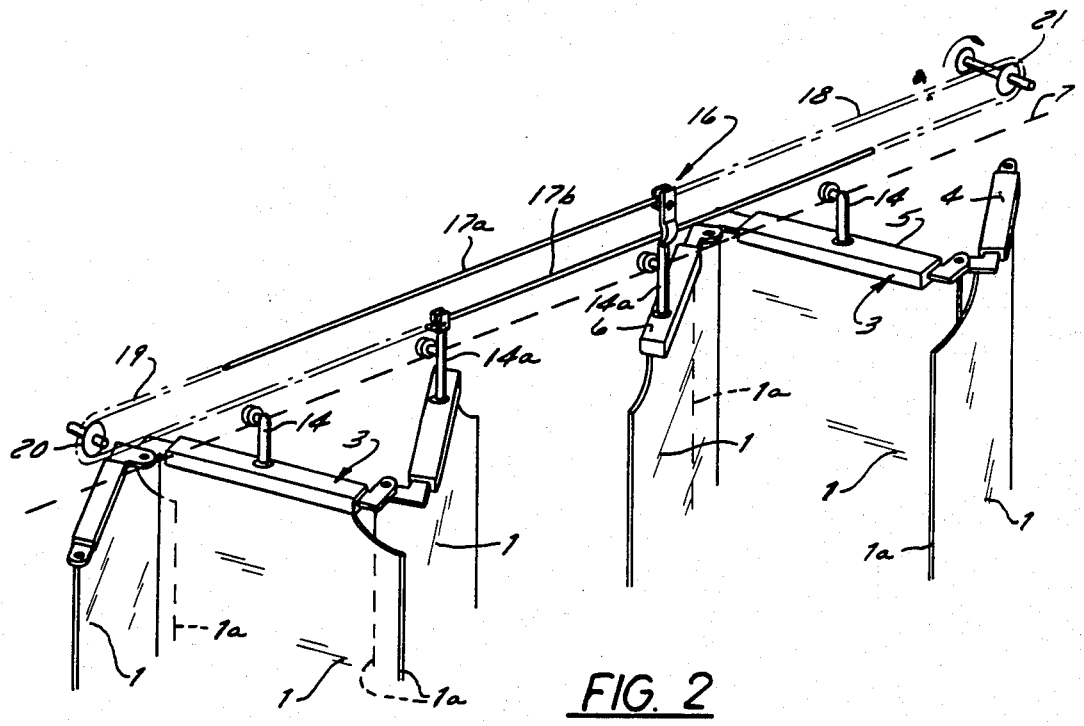
FIG. 2 PRIOR ART
FIG. 2 is a partial, perspective view of suspension system of the prior art for a high-speed, horizontal folding door.
Figure 3:
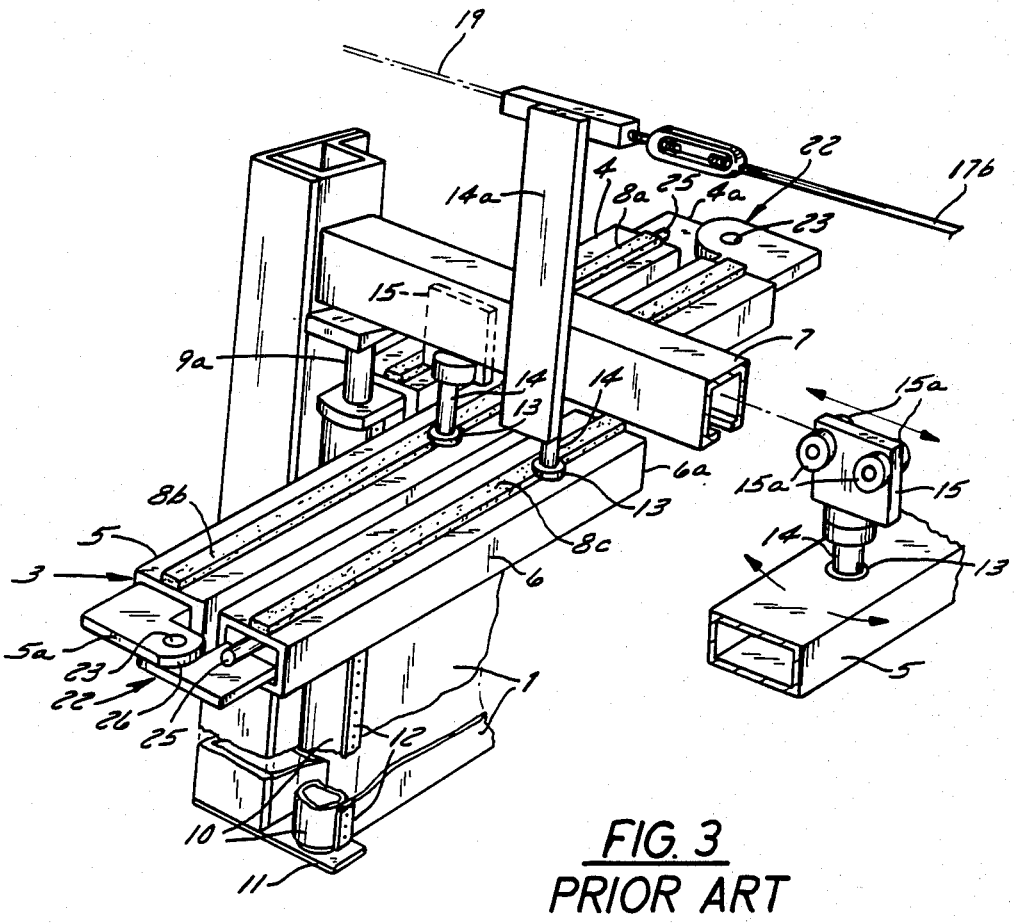
FIG. 3 PRIOR ART
FIG. 3 is an enlarged partial perspective view of the suspension system shown in FIG. 2.

As previously described, FIGS. 2–3 generally illustrate a high-speed, horizontal folding door of the type generally contemplated for use in conjunction with the frost control system of the invention. Such a known design for a horizontal folding door combines the advantages of an overhead suspension system including a series of hinged, fan-foldable rack sections with a means for automatically opening and closing the door. Klein proposed such a system in German Pat. No. 3,048,763 published Sept. 6, 1983. The entire contents of the German Pat. No. 3,048,763 are hereby expressly incorporated herein by reference. Doors of the Klein type have been manufactured and sold by Rytec Corporation, Jackson, Wis. since about 1985.

As shown in FIGS. 2 and 3, a known folding door for use with the present invention includes a series of flexible transparent strips 1 having overlapping edge portions 1*a* each attached to a rack 3 consisting of jointed folding arms or sections 4, 5 and 6 which can be folded along a guide track 7. In installations, such as freezer cases, where limiting air infiltration past the door is important, seal members 8*a*, 8*b* and 8*c* are fitted to the top surface of each of folding arms 4, 5 and 6 to close the gap between folding arms 4, 5 and 6 and guide track 7 when the door is closed. Seal members 8*a*, 8*b* and 8*c* may be either flexible elastomeric blades of appropriate length suitably secured to the upper surface of arms 4, 5 and 6 or flexible polymeric bristles of appropriate length suitably secured to the upper surface of arms 4, 5 and 6. Such blades or bristles are readily available from a number of sources known to workers in the art.

Section 4 located nearest the doorway edge is linked to a bearing bolt 9*a* attached to a side jamb 9 below guide track 7. A hinge pipe 10 is pivotally connected to bearing bolt 9*a* and descends downwardly from bearing bolt 9*a* to pivotal attachment with a bearing plate 11. Hinge pipe 10 is fitted with a flange 12 to which the outer edge of outer flexible transparent strip 1 is attached.

A free end 4*a* of rack section 4 is joined to second rack section 5 of double length which is attached at its center by a swivel joint 13 and a support rod 14 to a carriage 15 which comprises a vertically oriented plate having a series of rollers 15*a* mounted thereon. Rollers 15*a* engage the inner periphery of guide track 7, as illustrated in FIG. 3.

Second rack section 5 has an end 5*a* connected to third rack section 6 which moves in parallel with first rack section 4. An end portion 6*a* of rack section 6 is attached by a swiveling joint 13*a* and an extended support rod 14*a*.

A draw cable assembly 16 and a pair of draw rods 17*a*, 17*b* are disposed above guide track 7 and are connected to extended support rods 14*a* of rack section 6. Sprocket chains 18, 19 connected to draw rods 17*a*, 17*b* are guided by sprocket wheels 20, 21, at least one of which is powered by a suitable motor (not shown) to turn in either direction to open and close the door, respectively.

Hinge pins 23 of hinges 22 connecting respective rack sections 4, 5 and 6 are offset relative to an imaginary vertical longitudinal plane bisecting rack sections 5, 6. This allows sections 4, 5, 6 to fold parallel to each other in the manner shown in FIG. 3. Hinge connections 22 may further have spring biased studs 25 which protrude from the end of at least one of each two adjoining sections 4, 5 and 5, 6 which assist hinging by exerting pressure on abutment end surface 26 of rack section end 5*a*, as illustrated in FIG. 3.

The foregoing detailed description of the folding door is recited here as the present invention has features in common with this type of known folding door and tracking system. However, the invention is readily applicable to folding doors having other types of specific mechanisms.

Figure 4:
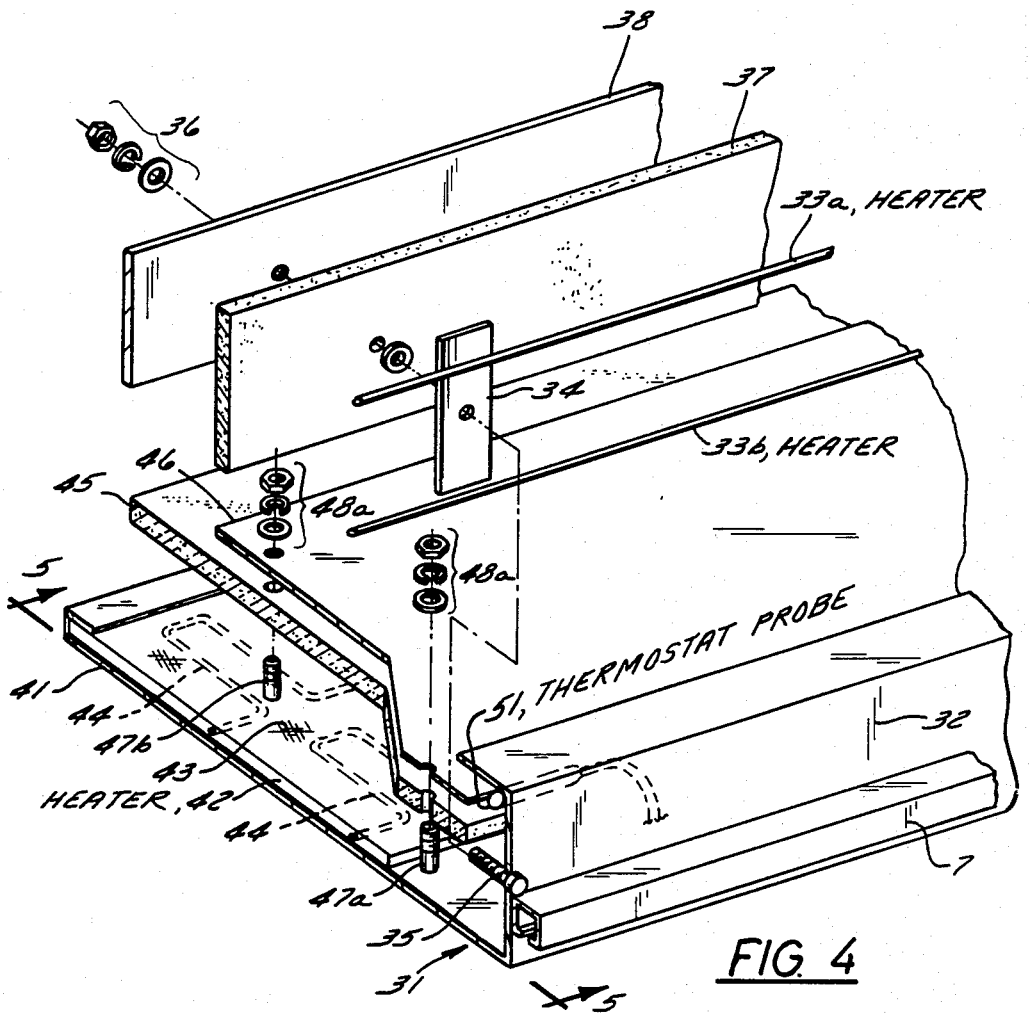
FIG. 4 is an exploded, sectional perspective view taken along line 4—4 in FIG. 1 of the header portion of the invention.
Figure 5:
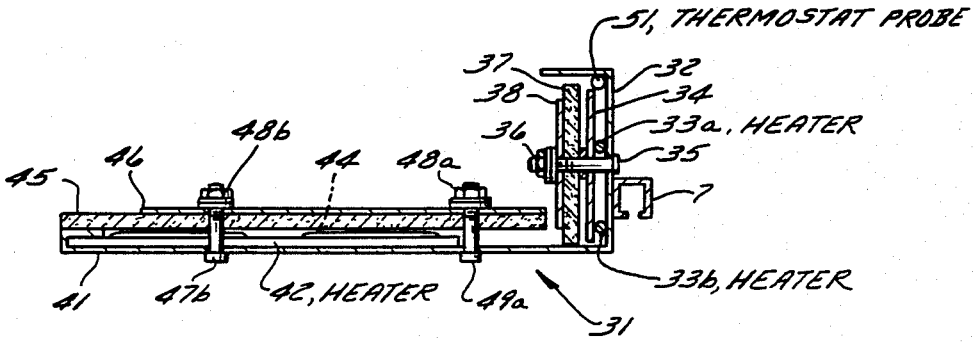
FIG. 5 is a sectional view taken along line 5—5 in FIG. 4 of the structure of FIG. 4 in assembled condition.

FIGS. 4–5 illustrate a preferred embodiment of the frost control system according to the present invention in which guide track 7 is attached to a front vertical support panel 32 which is integrally a part of a header 31. The header is generally constructed of a heavy gauge sheet steel.

On the inside of front vertical support panel 32 of header 31, one or more heating elements 33*a* and 33*b* are placed in intimate contact with the interior surface of vertical support panel 32. Preferably, the heating elements should be in the form of electrical copper tube heaters capable of heat output on the order of 10 watts per linear foot of heater. Such copper tube heaters are available from Easy Heat, Inc., New Carlisle, Ind.

Intimate contact between heat tubes 33*a* and 33*b* with the inside surface of vertical support panel 32 is maintained by a retention plate 34 which slips over a stud 35 and is clamped in place against the inside surface of vertical face 32 by the action of a clamping means 36 comprising a washer, lockwasher and nut as will be more fully described. Stud 35 and clamping means 36 should be repeated at sufficiently close intervals to insure that heat tubes 33*a* and 33*b* are in intimate contact with the inside surface of vertical support panel 32.

Behind the heat tubes is preferably placed a heat resistant, highly closed cell insulating layer 37. Insulating layer 37 insures that heat generated by heat tubes 33*a* and 33*b* is directed into vertical panel 32 so that guide track 7 receives (by conduction) heat sufficient to keep it frost and ice free.

Preferably, insulating layer 37 is a vinyl nitrile polymeric foam having a density of an average of 4.5 to 8.5 pounds per cubic feet, a water absorption by weight of about 0.1 pounds per square foot of cut surface, a high continuous temperature resistance of 150° F., a burn rate of zero inches per minute and better than 95% closed cells.

Insulating layer 37 preferably has a high heat resistance and low flammability because of its contact with heat tubes 33*a* and 33*b* in order to prevent risk of fire or other damage to either insulating layer 37 or to the door structure and its surroundings.

High closed cell ratio and low water absorption are preferred because the typical, high humidity, low temperature environment in which the present invention is intended to operate results in large amounts of condensate water forming on insulating layer 37. If high closed cell ratio and low water absorption are not present, the insulating layer 37 will absorb condensate water which will freeze in time in the interstices of the insulating layer 37 effectively eliminating its insulating capabilities.

A high closed cell, low water absorption, high fire resistant material satisfactory for this use is available from Milwaukee Rubber Products of Menomonee Falls, Wis. and is known as Stock No. R1800FS.

Figure 7:
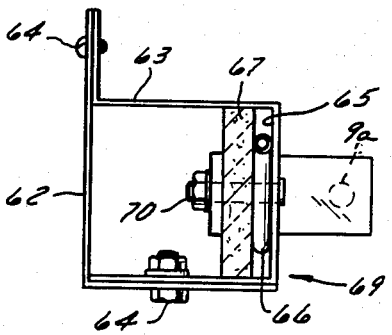
FIG. 7 is a top plan view of the door jamb of the embodiment of FIG. 6 in assembled condition.

Insulating layer 37 is held in place by steel retaining plate 38 which cooperates with the aforementioned stud 35 and clamping means 36 to clamp the insulating material in position against heat tubes 33*a* and 33*b*. It will be evident to workers skilled in the art that the resultant structure is a sandwich configuration as illustrated in FIG. 7 which effectively provides heat to the front outer surface of vertical support panel 32 of the header, thereby insuring absence of frost and ice from guide track 7 and the surrounding area adjacent to the folding area mechanism of the door.

The outside of lower member 41 of header 31 is also subject to frosting or ice formation during use in a cold, damp environment. Hence, heat should be applied to lower member 41 as well. The inventor earlier attempted utilizing conventional electrical resistance heating wires placed against the inside surface of the lower member 41 of header 31. These heat wires were placed in spaced longitudinal rows on the inside of lower member 41, and were held in place with heat resistant tape. In practice it was discovered that such manufacturing process was extremely time consuming and expensive and resulted in a structure with low reliability with respect to the stability of the positioning of the heat wires and resulted in nonuniform heating of the outer surface of lower member 41.

It has been discovered that these problems could be overcome and the associated manufacturing time and cost of the door greatly reduced by utilizing as a heating element in this portion of the header a fiber mesh heat mat material 42 which is comprised of an open-weave fiber glass mesh 43 with a continuous insulated copper heating element 44 permanently bonded thereto in a serpentine formation and installed in header 31 so as to cover a substantial fraction all of the inner surface of lower member 41. Such fiber glass mesh heat mats 42 are easily and rapidly installed and are available commercially in a variety of sizes and heating capacities, cause the heating element 44 to remain permanently in place (because it is bonded to mesh 43 which covers nearly all of the inside face of lower member 41 and is, hence, effectively immobilized), and have a minimal number of electrical connections as compared to conventional heat wire installations. Such fiber mesh heat mats are available from Easy Heat, Inc. of New Carlisle, Ind. and are known as Series G fiber mesh heat mats.

These mats have a heating capacity of approximately 40 watts/sq. ft to 60 watts/sq. ft. Such mats are designed for and are used extensively for embedding into asphalt or concrete for deicing driveways, airport runways and the like.

Heat mat 42 has behind it a closed cell second insulating layer 45 which is similar in its composition to insulating layer 37 earlier described.

The assembly of heat mat 42 and second insulating layer 45 are held in place by a retention plate 46 which cooperates with an appropriate number of studs 47*a* and 47*b* and with fastening means 48*a* and 48*b*.

As will be evident, the resultant structure is a sandwich of retention plate 46, second insulating layer 45 and heating mat 42 as illustrated in FIG. 5. Such structure provides intimate, complete and uniform transfer of heat from the heating mat 42 to the entire exterior surface (by conduction) of lower member 41 of header 32 and, hence insures that no ice or frost will interfere with the movement of rack sections 4, 5 and 6 of the door.

By virtue of the evenly applied heat and the judicious use of low water absorbing insulating layers, the resultant header structure provides for a substantially frost-free and ice-free environment in most circumstances at a low consumption of electrical energy.

The frost and icing difficulties associated with the header of a high-speed folding door are also present in the side jamb area wherein the side jamb comes in close proximity with bearing bolt 9*a*, hinge pipe 10 and lower support plate 11, as previously described.

Figure 6:
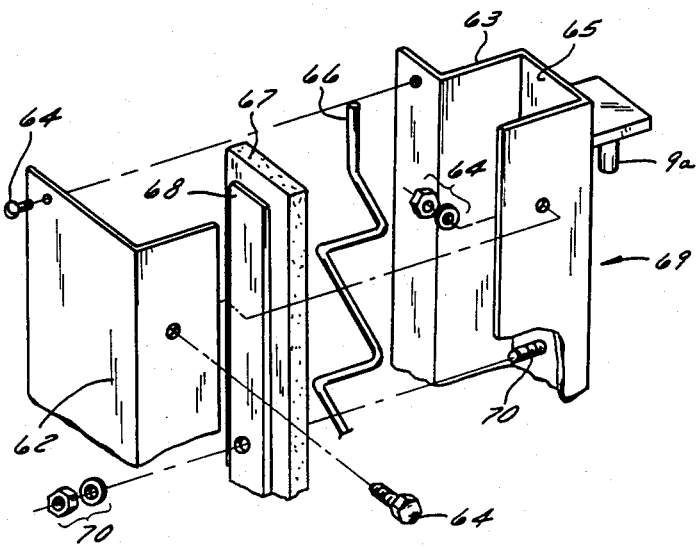
FIG. 6 is an exploded, partial perspective view of the door jamb of one embodiment of the invention.

In the embodiment illustrated by FIGS. 6 and 7, a jamb 69 of the door is formed of a first box section 62 and a second box section 63, which together form essentially a box shaped jamb 69 when fastened together by fasteners 64. Against the inside of a hinge wall 65 of second box section 63 is situated a jamb heat tube 66 which may be effectively in a serpentine form. Heat tube 66 may be of the same heat tube material as previously described header heat tubes 33*a* and 33*b* which is sufficiently flexible to be formed into serpentine form with conventional hand forming techniques but sufficiently rigid to retain its shape during assembly and in service. Jamb heat tube 66 is backed by a jamb insulating layer 67 which may effectively be of a material the same as previously described header insulating layers 37 and 45. The assembly of jamb heat tube 66 and insulating layer 67 is held in intimate contact with the interior hinge wall 65 by a steel retention plate 68 in cooperation with an appropriate number of fasteners 70. As will be apparent, the resultant structure is a sandwich of heat tube, insulating layer and retention plate as shown in FIG. 7.

Figure 8:
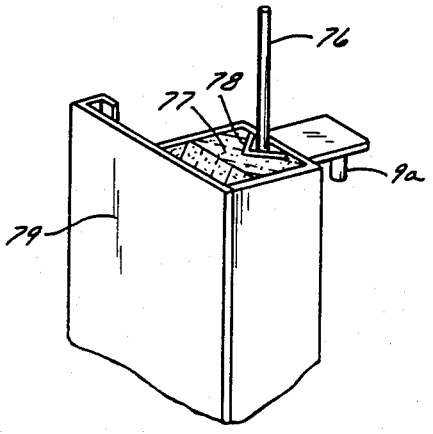
FIG. 8 is a partial perspective view of another embodiment of the door jamb showing the heat tube partially withdrawn from the heat tube passageway.
Figure 9:
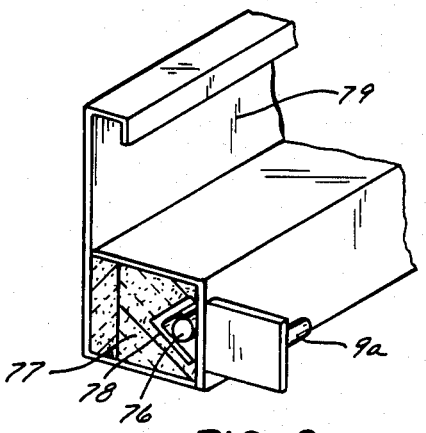
FIG. 9 is an assembled, partial perspective view of the door jamb of FIG. 8 shown at a different angle.

Another embodiment of the invention which has fewer parts and important assembly advantages is illustrated in FIGS. 8 and 9. In this embodiment the jamb is in the form of a welded box section 79 which has fabricated in it heat tube retention means which may effectively be in the form of an angle section 78 of steel welded into the interior wall of box section 79 on the side of box section 79 on which the door hinge pipe 10 will pass. Angle section 78 should be sized so that a heat tube 73 will intimately contact both the interior wall of box section 79 and the interior wall of angle section 78 when heat tube 76 is inserted into the triangular channel formed by the combination of the wall of box section 79 and angle 78. Jamb insulating layer 77 may be force fit into the open space of box section 79 immediately adjacent to angle section 78 and may be of the same closed cell material previously described.

In addition to having fewer parts than the previously described embodiment of FIGS. 4 and 5, this embodiment is particularly advantageous when it is desired to install a door in a tunnel or other location where access to the outside of the jamb structure for installation or removal of the heat tube is not possible. The open top of the angle section 78 permits heat tube 73 to be inserted or removed from the jamb structure from the top of the door so long as a suitable access port is provided in the header.

It has been discovered that substantial frost and ice elimination at the header and jambs does not require continuous operation of the disclosed heaters. Rather, satisfactory frost and ice elimination at both the header and the jambs is possible if the surface temperature of the header at the point most remote from the header heating elements is kept in the range of 48°-80° F. FIGS. 4-5 show a thermostat probe 51 in an appropriate location within the header remote from the header heating elements. Of course, probe 51 is connected to a suitable, conventional thermostatic switch wired into the circuit of the header and jamb heaters to cycle them on and off.

The inventor has found that a surface temperature at this location of 62° F. is most typically adequate to insure a substantially frost and ice free header and jamb at reasonable energy consumption.

Figure 1:
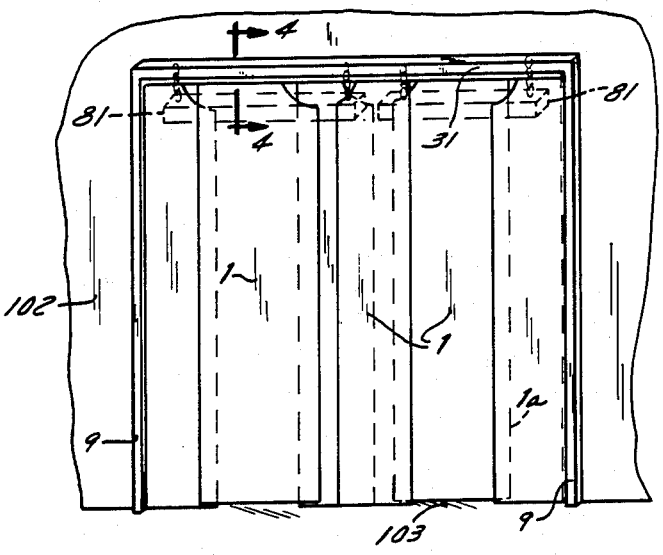
FIG. 1 is a front elevational view of a high-speed, horizontal folding door at the doorway of a freezer case or the like and showing the radiant heater portion of the invention.
Figure 10:
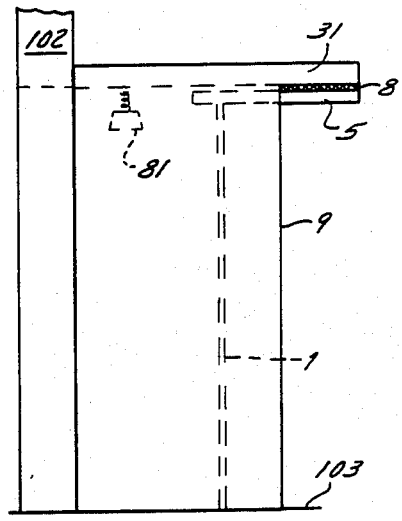
FIG. 10 is a side, elevational view of the door of FIG. 1.

In extremely cold and humid environments the frost control system described above may be effectively supplemented to prevent frost formation on the downwardly descending curtain of the door and on the floor of the door opening by the installation of one or more electric infrared heaters 81 on the lower surface of the header on the "warm side" of the door between descending curtain panels 1 and a wall 102 of the freezer compartment as illustrated in FIGS. 1 and 10. Such electric infrared heaters 81 are chosen to supply a sufficient amount of energy to prevent the formation of ice and frost on the descending curtain panel 1 and on the floor 103 of the door opening. The inventor has discovered that in most installations, two electric infrared heating units of 3,000 watts each are sufficient to prevent ice and frost formation on the door curtain and on the floor of the door opening in environments down to −20° F.

A suitable heater for such use is the Dayton 3E432 heater available from W. W. Grainger, Inc., Milwaukee, Wis.

It will be understood that the above description is of two preferred exemplary embodiments of the invention, and the invention is not limited to the specific form shown. Modifications may be made in the described elements without departing from the scope of the invention as expressed in the appended claims.

I claim:

1. A foldable door comprising:

a header including a front, generally vertical panel and a rear, generally horizontal panel, said header being disposed along a top of an associated doorway;

a downwardly depending foldable curtain disposed below said header;

curtain supporting means connected to said header and movably supporting said curtain for movement between a closed, extended position and an open, folded position in which an upper edge of said curtain is in close proximity to said rear panel, said supporting means including a generally C-shaped bracket for receiving a plurality of carriages associated with said curtain;

a pair of hollow jambs disposed along opposite sides of said doorway, each of said jambs having an inwardly directed, cantilevered hinge mounted thereon in opposing positions at either side of said doorway, said curtain supporting means being pivotally mounted on each of said hinges, each of said jambs including an internal chamber having an interior wall;

means for simultaneously raising both a surface temperature of said foldable curtain and a temperature at the floor level of said doorway above a frost formation temperature;

jamb temperature raising means disposed on said interior wall within said chamber of said jambs for raising a temperature of at least one of said jambs above the frost formation temperature, said jamb temperature raising means comprising:

a serpentine jamb heating element disposed on said interior wall of said jamb;

a first thermal insulating layer disposed over said jamb heating element; and first retention means for securing said first thermal insulating layer and said jamb heating element to said interior wall;

front panel temperature raising means disposed within said header for raising the temperature of said front panel above the frost formation temperature, said front panel temperature raising means comprising:

front panel heat transferring means disposed on an interior surface of said front panel for transferring heat to said front panel;

a second thermal insulating layer covering said front panel heat transferring means; and second retention means for securing said second thermal insulating layer and said front panel heat transferring means to said front panel; and rear panel temperature raising means disposed within said header for raising the temperature of said rear panel above the frost formation temperature, said rear panel temperature raising means comprising:

rear panel heat transferring means disposed on an upper face of said rear panel for transferring heat to said rear panel;

a third thermal insulating layer covering said rear panel heat transferring means; and third retention means for securing said thermal insulating layer and said rear panel heat transferring means to said interior face.

2. The folding door of claim 1, further comprising means including a thermostat probe mounted on said heater for actuating said temperature raising means of said front and rear panels in response to a decrease in temperature of said header below a predetermined level.

3. A foldable door comprising:

a header disposed along a top of a doorway, said header including a front, generally upright panel and a rear, generally horizontal panel;

a downwardly depending foldable curtain disposed below said header;

means connected to said header for movably supporting said curtain for movement between a closed, extended position and an open, folded position in which an upper edge portion of said curtain is disposed below said rear panel in close proximity thereto;

rear panel temperature raising means disposed on said header to raise a temperature of said rear panel above a frost formation temperature, said rear panel temperature raising means comprising:

rear panel heat transferring means superposed on an upper face of said rear panel to transfer heat to said rear panel;

a first thermal insulating layer covering said rear panel heat transferring means; and retention means for securing said first thermal insulating layer and said rear panel heat transferring means to said rear panel.

4. The foldable door of claim 3, further comprising means disposed within said header for raising the temperature of said front panel above the frost formation temperature, said front panel temperature raising means comprising:

front panel heat transferring means disposed on an interior surface of said front panel for transferring heat to said front panel;

a second thermal insulating layer covering said front panel heat transferring means; and second retention means securing said second thermal insulating layer and said front panel heat transferring means to said front panel.

5. The foldable door of claim 4, further comprising a pair of jambs disposed along each side of the doorway and below said header, at least one of said jambs having a cantilevered hinge mounted thereon, said curtain supporting means being pivotally mounted on said hinge.

6. The foldable door of claim 5, wherein each of said jambs has an internal chamber therein having an interior wall, said door further comprising jamb temperature raising means disposed within said chamber of at least one of said jambs for raising the temperature of at least one of said jambs above the frost formation temperature, said jamb temperature raising means comprising:

a serpentine jamb heating element disposed on said interior wall of said jamb;

a third thermal insulating layer disposed over said jamb heating element; and third retention means for securing said third thermal insulating layer and said jamb heating element to said interior wall.

7. The foldable door of claim 6, wherein said third retention means comprises a plate interposed between said jamb heating element and said third insulating layer, and means for securing said plate to said jamb.

8. The foldable door of claim 3, wherein said rear panel heat transferring means comprises a first heating element and means for securing said first heating element on said rear panel from movement and for distributing heat from said heating element to said rear panel.

9. The foldable door of claim 8, wherein said first heating element comprises a serpentine electrical resistance heater extending over substantially the entirety of said upper face of said rear panel and said securing and distributing means comprises an open weave fiber glass mesh.

10. The foldable door of claim 9, wherein said first heating element has an output in the range of about 40 to 60 watts per square foot.

11. The foldable door of claim 3 wherein said first insulating layer is comprised of a substantially closed cell, substantially non-water absorbing, substantially nonflammable foam material.

12. The foldable door of claim 11 wherein said first insulating layer is made of vinyl nitrile foam.

13. The foldable door of claim 3, wherein said rear panel heat transferring means comprises a first heating element bonded to a layer of mesh material which substantially completely covers said upper face of said rear panel, and said first insulating layer comprises a foam material disposed in face-to-face contact with said mesh.

14. A foldable door comprising:

a header including a front, generally vertical panel and a rear, generally horizontal panel, said rear panel being fixedly secured to a lowermost portion of said front panel, and said header being disposed along a top of an associated doorway;

a downwardly depending foldable curtain disposed below said header;

means connected to said header for movably supporting said curtain for movement between a closed, extended position and an open, folded position in which an upper edge of said curtain is in close proximity to said rear panel, said supporting means including a generally C-shaped bracket for receiving a plurality of carriages associated with said curtain; and front panel temperature raising means disposed within said header for raising the temperature of said front panel above a frost formation temperature, said front panel temperature raising means comprising:

front panel heat transferring means disposed on an interior surface of said front panel for transferring heat to said front panel;

a thermal insulating layer covering said front panel heat transferring means; and retention means for securing said thermal insulating layer and said front panel heat transferring means to said interior face.

15. A foldable door comprising:

a header including a front, generally vertical panel and a rear, generally horizontal panel, said rear panel being secured to a lowermost portion of said front panel, and said header being disposed along a top of an associated doorway;

a downwardly depending foldable curtain disposed below said header;

curtain supporting means connected to said header and movably supporting said curtain for movement between a closed, extended position and an open, folded position in which an upper edge of said curtain is in close proximity to said rear panel;

a pair of hollow jambs disposed along opposite sides of said doorway, each of said jambs having an inwardly directed, cantilevered hinge mounted thereon in opposing positions at either side of said doorway, said curtain supporting means being pivotally mounted on each of said hinges, each of said jambs including an internal chamber having an interior wall;

jamb temperature raising means disposed on said interior wall within said chamber of at least one of said jambs for raising the temperature of at least one of said jambs above a frost formation temperature, said jamb temperature raising means comprising:

a serpentine jamb heating element disposed on said interior wall of said jamb;

a thermal insulating layer disposed over said jamb heating element; and retention means for securing said thermal insulating layer and said jamb heating element to said interior wall.

16. The foldable door of claim 15, wherein said retention means comprises an angled metal plate interposed between said jamb heating element and said thermal insulating layer, and means for securing said plate to said jamb.

17. A foldable door comprising:

a header including a generally vertical front panel and a generally horizontal rear panel, said rear panel being in close proximity to a lowermost portion of said vertical support panel, and said header being disposed along a top of an associated doorway;

a downwardly depending foldable curtain disposed below said header;

supporting means connected to said header and movably supporting said curtain for movement between a closed, extended position and an open, folded position in which an upper edge of said curtain is in close proximity to said rear panel, said supporting means including a generally C-shaped bracket mounted on said front panel for receiving a plurality of carriages associated with said curtain;

a pair of hollow jambs disposed along opposite sides of said doorway, each of said jambs having an inwardly directed, cantilevered hinge mounted thereon in opposing positions at either side of said doorway, said curtain supporting means being pivotally mounted on each of said hinges, each of said jambs including an internal chamber having an interior wall;

means for raising a temperature at the floor level of said doorway above a frost formation temperature.

18. The foldable door of claim 17, wherein said means for raising the temperature at the floor level comprises an electrical radiant heater connected to said rear panel.

* * * * *